US008615951B2

(12) United States Patent
Kosch

(10) Patent No.: US 8,615,951 B2
(45) **Date of Patent: *Dec. 31, 2013**

(54) SLAT WALL ASSEMBLY

(75) Inventor: Paul James Kosch, Spring Lake, MI (US)

(73) Assignee: Koschco, LLC, Spring Lake, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/316,590

(22) Filed: Dec. 12, 2008

(65) Prior Publication Data

US 2009/0249727 A1 Oct. 8, 2009

Related U.S. Application Data

(63) Continuation of application No. 10/317,795, filed on Dec. 12, 2002, now Pat. No. 7,464,511.

(51) Int. Cl.
*E04F 13/00* (2006.01)
*E04F 13/08* (2006.01)

(52) U.S. Cl.
CPC ..... *E04F 13/0864* (2013.01)
USPC ..... 52/520; 52/506.08; 52/506.1; 52/536; 52/539; 52/546

(58) Field of Classification Search
USPC ..... 52/36.5, 506.08, 506.09, 506.1, 507, 52/509, 511, 512, 520, 536, 537, 539, 543, 52/546, 589.1, 592.1, 36.4, 36.6, 545, 52/549; 211/87.01, 94.01; 403/331
See application file for complete search history.

(56) References Cited

U.S. PATENT DOCUMENTS

| | | | | |
|---|---|---|---|---|
| 3,127,962 | A | | 4/1964 | James |
| 3,606,720 | A | * | 9/1971 | Cookson ..... 52/714 |
| 3,780,483 | A | | 12/1973 | Mattes |
| 4,122,643 | A | | 10/1978 | Hafner |
| 4,292,781 | A | * | 10/1981 | Chalmers et al. ..... 52/547 |
| 4,450,970 | A | | 5/1984 | Shepherd |
| 4,522,007 | A | | 6/1985 | Oehlert |
| 4,531,331 | A | | 7/1985 | Itagaki |
| 4,570,404 | A | | 2/1986 | Knudson |
| 4,607,753 | A | | 8/1986 | Radek |
| 4,672,789 | A | | 6/1987 | Fortier |
| 4,878,331 | A | | 11/1989 | Taylor |
| 4,936,078 | A | | 6/1990 | Porter |
| 4,961,295 | A | | 10/1990 | Kosch, Sr. et al. |
| 5,125,518 | A | | 6/1992 | Ward |
| 5,140,793 | A | | 8/1992 | Knudson |
| 5,170,605 | A | | 12/1992 | Huddle |
| 5,191,743 | A | | 3/1993 | Gailey |
| 5,224,610 | A | | 7/1993 | Veazey |
| 5,409,120 | A | | 4/1995 | Miller et al. |

(Continued)

*Primary Examiner* — Mark Wendell
*Assistant Examiner* — Matthew J Smith
(74) *Attorney, Agent, or Firm* — King & Partners, PLC

(57) ABSTRACT

A slat wall assembly comprising a first slat, an attachment assembly, and a second slat. The first slat includes a body and a lower flange. The body includes an upper edge and a lower edge. The lower flange emanates from the lower edge of the body. The attachment assembly is associable with the lower flange of the first slat and facilitates attachment of the first slat to an existing wall. The second slat includes a body and an upper flange. The body includes an upper edge and a lower edge. The upper flange emanates from the upper edge of the body. The upper flange is configured to be insertable into the lower flange of the first slat and retainable therein.

1 Claim, 7 Drawing Sheets

(56) References Cited

U.S. PATENT DOCUMENTS

| | | | | |
|---|---|---|---|---|
| 5,412,912 | A | 5/1995 | Alves | |
| 5,438,810 | A | 8/1995 | Bullen et al. | |
| 5,675,955 | A | 10/1997 | Champagne | |
| 5,768,844 | A * | 6/1998 | Grace et al. | 52/549 |
| 5,791,093 | A | 8/1998 | Diamond | |
| 5,819,490 | A | 10/1998 | Current | |
| 5,878,543 | A | 3/1999 | Mowery | |
| 5,946,876 | A | 9/1999 | Grace et al. | |
| 6,122,877 | A | 9/2000 | Hendrickson et al. | |
| 6,134,846 | A | 10/2000 | Lamb | |
| 6,195,952 | B1 | 3/2001 | Culpepper et al. | |
| 6,370,832 | B1 | 4/2002 | McGarry et al. | |
| 7,464,511 | B2 | 12/2008 | Kosch | |
| 2003/0014877 | A1 | 1/2003 | Nadal et al. | |
| 2003/0101611 | A1 | 6/2003 | Bueno | |
| 2006/0144002 | A1 * | 7/2006 | Charlwood | 52/519 |

* cited by examiner

SLAT WALL ASSEMBLY

This application is a continuation of application Ser. No. 10/317,795, filed Dec. 12, 2002, U.S. Pat. No. 7,464,511, issued Dec. 16, 2008, which is hereby incorporated herein by references in its entirety.

BACKGROUND OF THE INVENTION

1. Field of the Invention

The invention relates in general to a slat wall system, and, more particularly, to a metal slat wall system having a simplified installation and assembly, to, in turn, facilitate installation and assembly by consumers.

2. Background Art

Slat walls have been known in the art for many years. Typically, conventional slat walls comprise a plurality of slats and a frame member. The frame member is attached to a wall or outside surface. Subsequently, the slats are attached to the frame member to complete the slat wall. Once complete, users can selectively attach shelving units and other storage and display accessories to the slat wall. Slat walls provide an aesthetically pleasing storage assembly, and, in addition, permit a user to quickly reconfigure and re-deploy the shelving units and other storage and display items which are attached to the slat wall.

While such slat walls have become quite popular for the above-identified reasons, a plurality of problems and/or drawbacks exist in association with their use. For example, among other drawbacks, the frame member is often difficult to properly install. In many instances, the frame member includes a plurality of components which must be individually aligned and installed in a particular orientation relative to the wall or outside surface and relative to the other components. Moreover, in many prior art designs, slats are difficult to assemble relative to the frame and relative to other slats. As such, great skill is required to properly install such a slat wall. Often, such slat walls are installed by professional slat installation personnel.

As a result, it is an object of the present invention to, in turn, overcome the deficiencies of the prior art.

SUMMARY OF THE INVENTION

The invention comprises a slat wall assembly. The slat wall assembly comprises a first slat, an attachment assembly, and a second slat. The first slat includes a body and a lower flange. The body includes an upper edge and a lower edge. The lower flange emanates from the lower edge thereof. The attachment assembly is associable with the lower flange of the first slat. The attachment assembly facilitates attachment of the first slat to an existing wall. The second slat includes a body and an upper flange. The body includes an upper edge and a lower edge. The upper flange emanates from the upper edge. The upper flange is configured to be insertable into the lower flange of the first slat and retainable therein.

In a preferred embodiment, the lower flange comprises a contour extending from a lower edge thereof having, in succession, a bulge region, an inward wall, a downward wall, and an outward wall. In one such embodiment, the upper flange comprises a contour extending from an upper edge thereof having, in succession, an inward wall, an upward wall, and an outward wall. In one embodiment of the type, the downward wall of the lower flange further includes a retaining recess capable of cooperating with an attachment assembly. In another embodiment of the type, the downward wall of the lower flange further includes a plurality of openings positioned along the retaining recess at predetermined intervals.

In yet another preferred embodiment, the first slat further includes an upper flange extending from the upper edge of the body thereof and the second slat further includes a lower flange extending from the lower edge of the body thereof.

In another preferred embodiment, the slat wall assembly further comprises a trim assembly positioned along an edge of the first and second slats. In such an embodiment, the trim assembly further includes a base bracket having one of at least one leg and at least one receiving region and a finishing bracket having the other of at least one leg and at least one receiving region. The finishing bracket and the base bracket are releasably associated with each other by way of the at least one leg and the at least one receiving region.

In another aspect of the invention, the invention comprises a wall assembly formed from a plurality of slats. Each slat comprises a body, an upper flange, and a lower flange. The body includes an upper edge and a lower edge. The upper flange emanates from the upper edge of the body. The lower flange emanates from the lower edge. The upper flange is configured to be insertable into the lower flange of a first slat and lockable therein. This, in turn, facilitates the assembly of a wall assembly through successive insertion of an upper flange of a slat with a lower flange of an adjoining slat.

In one embodiment of the invention, each slat includes a region capable of attachment to an existing structure by way of an attachment assembly.

In another embodiment of the invention, each slat is substantially identical in configuration.

In yet another embodiment of the invention, each upper flange and lower flange is structurally configured such that an upper flange of a first slat is insertable into a lower flange of a second slat and rotatable relative to the upper flange, to, in turn, retain the two slats in operative engagement.

In one embodiment, at least one of the slats is attached to an existing structure by way of an attachment assembly.

In another aspect of the invention, the invention comprises a method for assembling a wall assembly. The wall assembly comprises the steps of (a) providing a first slat having a body with a lower edge and a lower flange extending from the lower edge; (b) attaching the first slat to an existing outside surface with an attachment assembly; (c) providing a second slat having an upper edge and an upper flange extending from the upper edge of the second slat; (d) positioning the upper flange of the second slat into abutment with the lower flange of the first slat; and (e) attaching the upper flange of the second slat to the lower flange of the first slat.

In one embodiment, the method comprises the step of attaching the second slat to the existing surface by way of an attachment assembly.

In another embodiment, the second slat further includes a lower edge and a lower flange extending from the lower edge of the second slat. In such an embodiment, the method further comprises the steps of: (a) providing a third slat having an upper edge and an upper flange extending from the upper edge of the third slat; (b) positioning the upper flange of the third slat into abutment with the lower flange of the second slat; and (c) attaching the upper flange of the third slat to the lower flange of the second slat.

In one embodiment, the method further comprises the step of aligning the first slat on the existing wall with a level.

In another aspect of the invention, the invention further comprises a method of assembling a wall assembly. The method comprises the steps of: (a) providing a plurality of slats, each slat having an upper flange extending from an upper edge thereof, and a lower flange extending from a lower edge thereof; (b) attaching a first slat to an outside surface by way of an attachment assembly; and (c) sequentially attaching the upper flange of a successive slat to the lower flange of the preceding slat, to, in turn, assemble a wall assembly.

In one embodiment, the method further comprises the step of attaching at least one slat other than the first slat to an outside surface by way of an attachment assembly.

Preferably, the step of attaching further comprises the step of attaching each slat to an outside surface by way of an attachment assembly.

BRIEF DESCRIPTION OF THE DRAWINGS

The invention will be described with reference to drawings wherein.

DETAILED DESCRIPTION OF THE INVENTION

Figure 1:
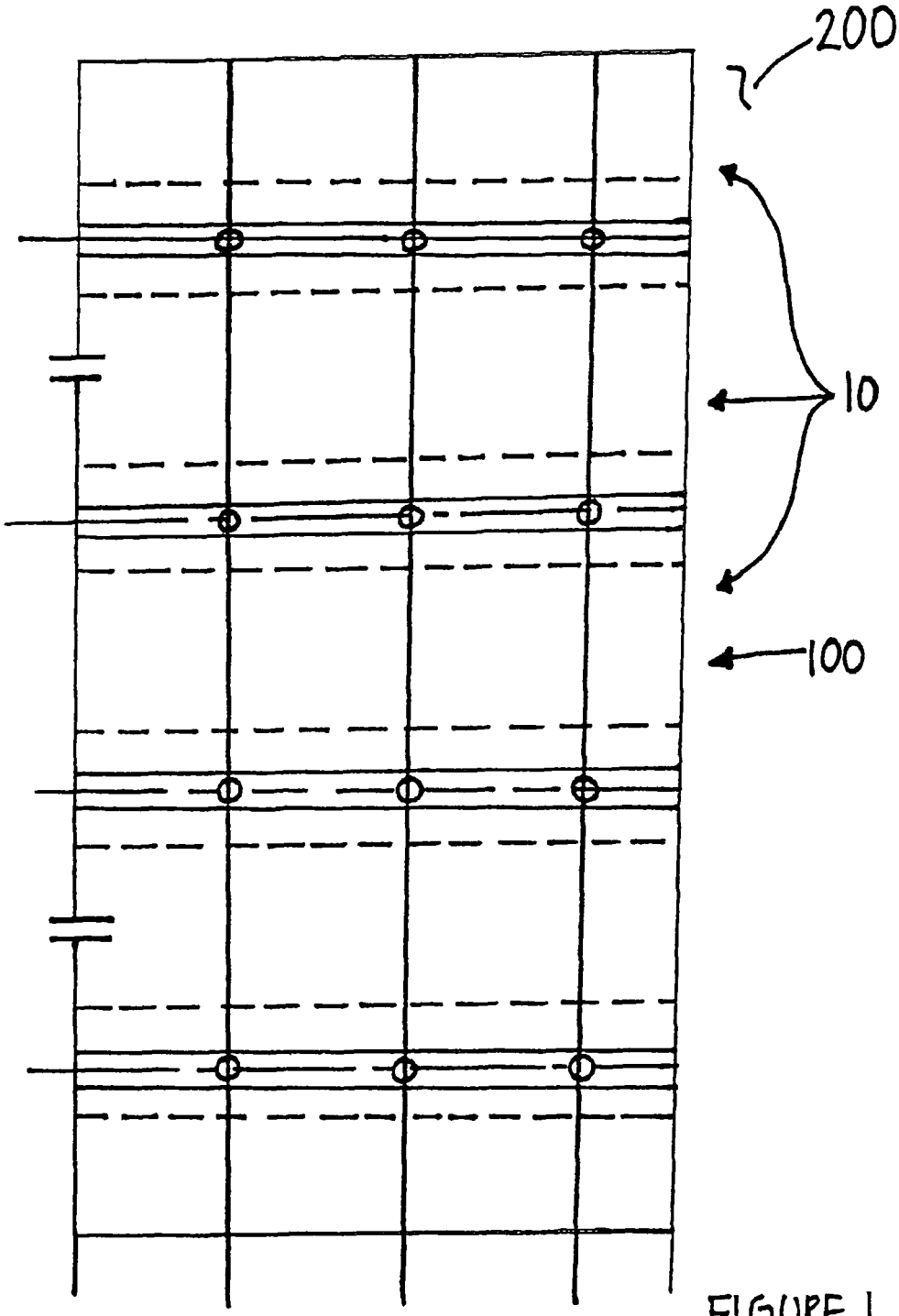
FIG. 1 of the drawings is a perspective view of an embodiment of the present invention.

While this invention is capable of embodiment in many different forms, there is shown in the drawings and will be described herein in detail, one specific embodiment with the understanding that the present disclosure is to be considered as an exemplification of the principles of the invention and is not intended to limit the invention to the embodiment illustrated.

It will be understood that like or analogous elements and/or components, referred to herein, are identified throughout the drawings by like reference characters. In addition, it will be understood that the drawings are merely representations, and some of the components may have been distorted from actual scale for purposes of pictorial clarity.

Referring now to FIG. 1, slat wall assembly 100 is shown as generally comprising a plurality of slats 10 which are both mounted to wall 200 and to each other. Preferably, the slats comprise an elongated metal material which has been extruded or otherwise formed into the desired shape. With respect to size, it is contemplated that each slat may comprise a height, for example, in excess of 1" on center and a thickness of about 0.75 inches. Of course, various embodiments may be differently sized and shaped, and the disclosed embodiment is merely one example of the dimensions. In one embodiment, slats 10 may comprise a 0.030 ga steel. Of course, other metals and alloys thereof are contemplated for use. Such materials may be anodized, brush finished, painted or otherwise coated or treated to achieve the desired appearance. Additionally, the separate slats may comprise plastic members.

Figure 2:
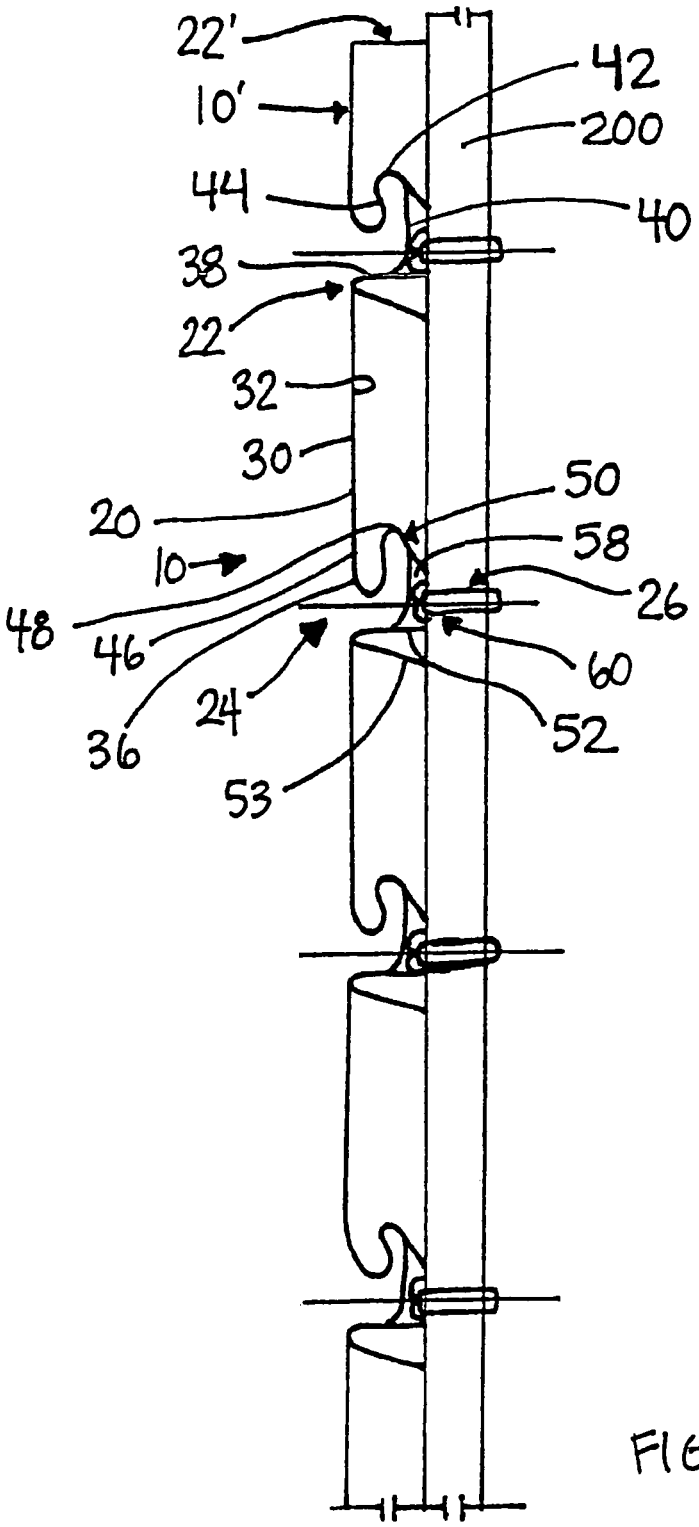
FIG. 2 of the drawings is a cross-sectional view of an embodiment of the present invention.
Figure 3:
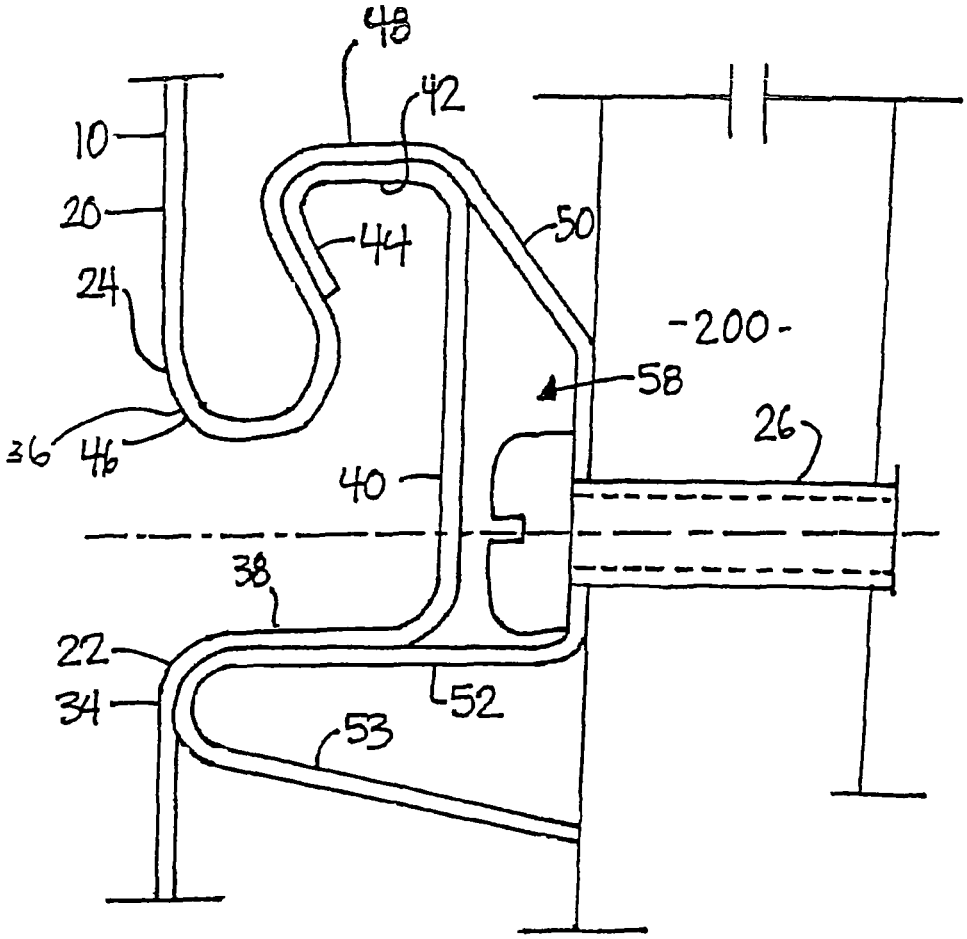
FIG. 3 of the drawings is a cross-sectional view of an embodiment of the present invention.

Referring now to FIGS. 2 and 3, each slat 10 includes body 20, upper flange 22, and lower flange 24. As will be explained, each slat may be retained to the underlying wall 200 via an attachment assembly 26. Body 20 is shown in FIGS. 2 and 3 as comprising front surface 30, rear surface 32, upper edge 34 and lower edge 36. Front surface 30 generally comprises a planar surface, however, it is likewise contemplated that the front surface may include a particular configuration (i.e., an embossing, etc.). Generally, inasmuch as the body is substantially uniform in thickness, the rear surface is generally parallel to the front surface, however, various other embodiments are likewise contemplated for use. Upper edge 34 and lower edge 36 are generally uniformly spaced apart and parallel to each other.

Upper flange 22 is shown in FIGS. 2 and 3 as extending from upper edge 34. As will be explained, the upper flange cooperates with a lower flange of an adjoining slat, to engage same. Upper flange 22 defines a channel, the contour of which includes inward wall 38, upward wall 40, outward wall 42 and finish wall 44. Inward wall 38 extends from upper edge 34 of body 20 in a generally inward direction. Upward wall 40 extends in a generally upward direction from inward wall 38. Outward wall 42 extends generally outwardly from upward wall 40 and is generally parallel to inward wall 38. Finish wall 44 extends both downwardly and inwardly (i.e., at an acute angle relative to outward wall 42). As is shown in FIG. 2, it will be understood that in certain embodiments, an upper, starter, slat 10' may be utilized. Such a starter slat includes upper flange 22' which is not configured for attachment to a lower flange, and which provides a decorative finish along the upper edge of slat wall assembly 100.

Figure 4:
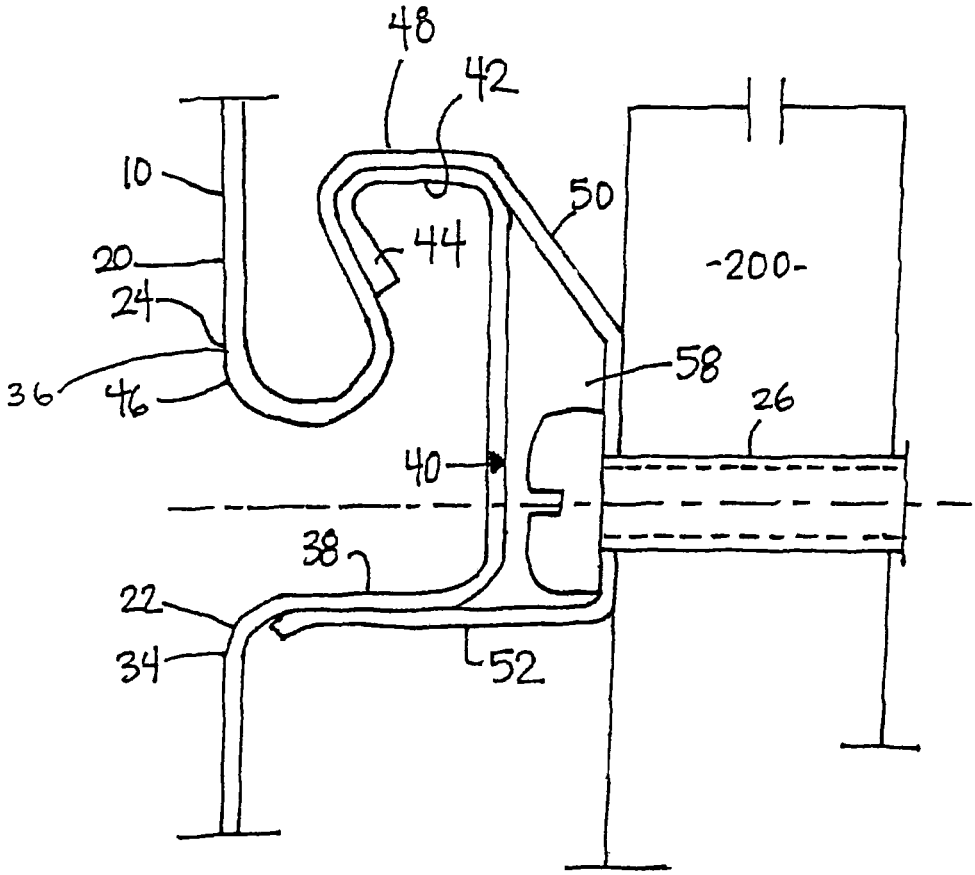
FIG. 4 of the drawings is a cross-sectional view of an embodiment of the present invention.

Lower flange 24 is shown in FIGS. 2 and 3 as extending from lower edge 36, and cooperates with an upper flange of an adjoining slat, to engage same. Lower flange 24 defines a channel the contour of which includes bulge region 46, inward wall 48, downward wall 50, outward wall 52 and support wall 53. Inward wall 48 generally extends inwardly from bulge region 46. Downward wall 50 extends in a generally downward orientation from inward wall 48 and includes retaining recess 58. Retaining recess 58 includes at least one opening therethrough for accommodating various attachment assemblies. Outward wall 52 extends away from downward wall 50. Support wall 53 extends from outward wall 52 and is interfaceable with the underlying wall. In another embodiment of the invention, as shown in FIG. 4, support wall 53 can be omitted from the lower flange.

As will be understood, the upper flange and the lower flange are configured so as to matingly engage. Specifically, inward wall 38 of upper flange 22 abuts outward wall 52 of lower flange 24. Upward wall 40 of upper flange 22 abuts downward wall 50 of lower flange 24. Outward wall 42 of upper flange 22 abuts inward wall 48 of lower flange 24. Finish wall 44 of upper flange 22 abuts bulge region 46 of lower flange 24. The abutting surfaces cooperate to facilitate locking yet releasable engagement of the upper and lower flanges of successive slats 10.

Figure 5:
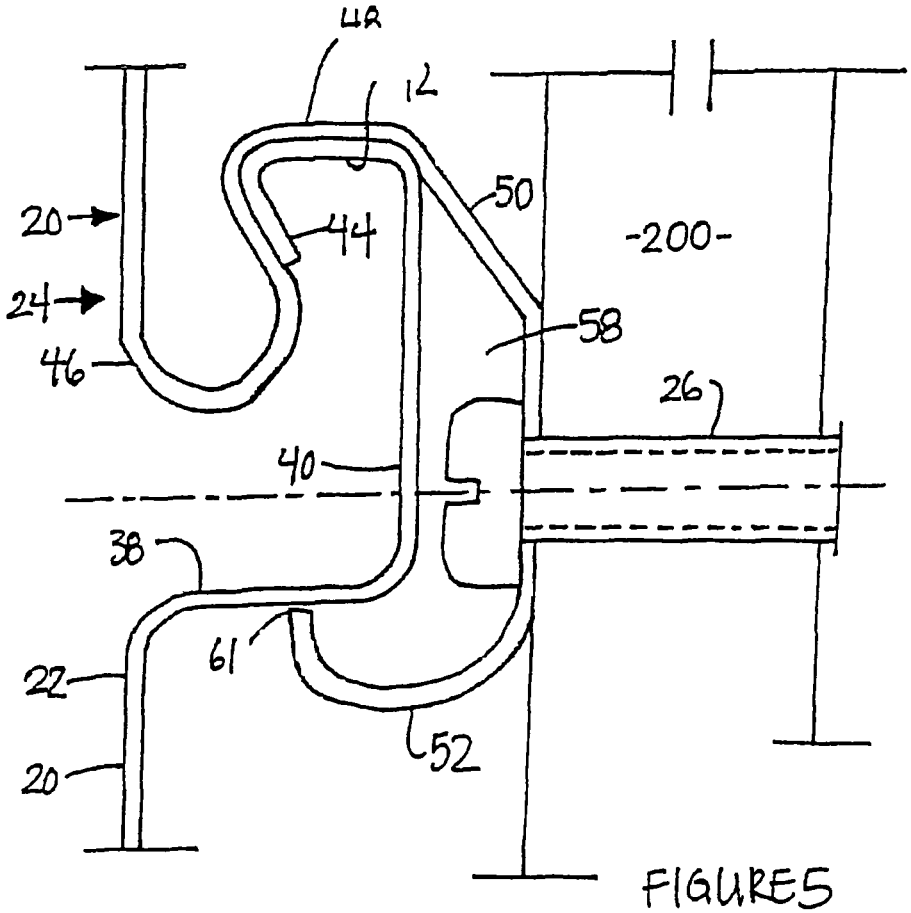
FIG. 5 of the drawings is a cross-sectional view of an embodiment of the present invention.

In another embodiment of the invention, as shown in FIG. 5, outward wall 52 of lower flange 24 of slat 10 comprises a substantially concave surface having edge 61. The edge of the concave surface then provides support for inward wall 38 of upper flange 22. When force is placed upon the lower flange, the lower flange can rotate about edge 61 thereby forcing outward wall 42 of the upper flange into bulge region 46 of the lower flange, thereby precluding any movement of the lower slat relative to the upper slat.

Attachment assembly 26 is shown in FIG. 2 as comprising a fastener. In the embodiment shown, the fastener may comprise a screw. Such fasteners can be positioned in multiple locations along the recessed region of the lower flange of each slat. It is contemplated that the recessed region may include a plurality of openings extending along the length thereof. Fasteners can be selectively placed in any one or more of the openings for fastening into wall 200 (i.e., in locations wherein the opening corresponds to an underlying stud in the wall). Of course, various other attachment assemblies are likewise contemplated for use, such as nails, screws, industrial adhesives, hanger assemblies mounted to the wall, dowels, and/or hooks.

To assemble wall assembly 100 upon wall 200, the user first obtains a plurality of slats 10 of a suitable length, surface finish, and size. These slats may be manufactured through a variety of different manufacturing processes. For example, the slats may be formed by metal fabricating equipment such as a press brake, roll form, extrusion, etc. Plastic members can be injection molded to the proper configuration. Indeed, the application is not limited to any particular configuration or form of manufacturing process.

Once the slats are provided, the user determines the location upon which the wall assembly is to be mounted. Next, the user places the first slat across the wall and positions the first slat at the upper end of the desired mounting region. The slat is then adjusted so that it is positioned in a level, horizontal orientation.

Once adjusted, the user attaches the slat to the wall via the attachment assembly. For example, the user can identify which openings 60 on the retaining recess 58 of the lower flange correspond to studs positioned behind the wall. The user can then extend fasteners through such identified openings, through the wall and into the studs. The user can extend fasteners through corresponding openings such that the slat is attached to each successive stud. In other embodiments, where studs are not conveniently positioned, the user can position anchors in the wall which the fasteners can engage. In further embodiments, wherein the walls comprise solid structures (i.e., concrete, blocks, wood, etc.), the user can fasten the attachment assembly as desired along the length of the slats.

Once the first slat is positioned and fastened, a successive slat can be introduced and attached to the lower end of the first slat. Specifically, to attach the second slat, the upper flange of the second slat is inserted into the lower flange of the first slat at an angle. Once inserted, the second slat is rotated toward the wall. This rotation fully inserts the upper flange of the second slat into the lower flange of the first slat.

The cooperation between the two flanges locks and retains the second slat in the engaged orientation. In particular, bulge region 46 of the lower flange of the first slat interfaces with outward wall 42 and finish wall 44 of the upper flange to preclude outward movement of the upper flange relative to the wall. Similarly, the interfacing between bulge 46 and finish wall 44 and the interfacing between inward wall 38 of upper flange 22 and outward wall 42 of the lower flange precludes vertical movement of the second slat relative to the first slat and the wall.

To further secure the second slat in the desired orientation, the user can utilize attachment assemblies to attach lower flange 24 to the wall. In other embodiments, it is contemplated that flanges of subsequent slats may or may not be secured to the wall via attachment assemblies, and, rather, the subsequent flanges can rely on the engagement between the corresponding and interfacing flanges.

Whether or not attachment assemblies are utilized, the user continues to attach subsequent slats in a manner similar to that which is explained above. Specifically, the user attaches the upper flange of a subsequent slat to the lower flange of the immediately preceding slat. This procedure continues until a wall assembly having the desired dimension, shape, and configuration is completed. A piece of molding or other trim can be utilized to cover the exposed lower flange 24 of the final slat of the slat wall assembly.

Figure 6:
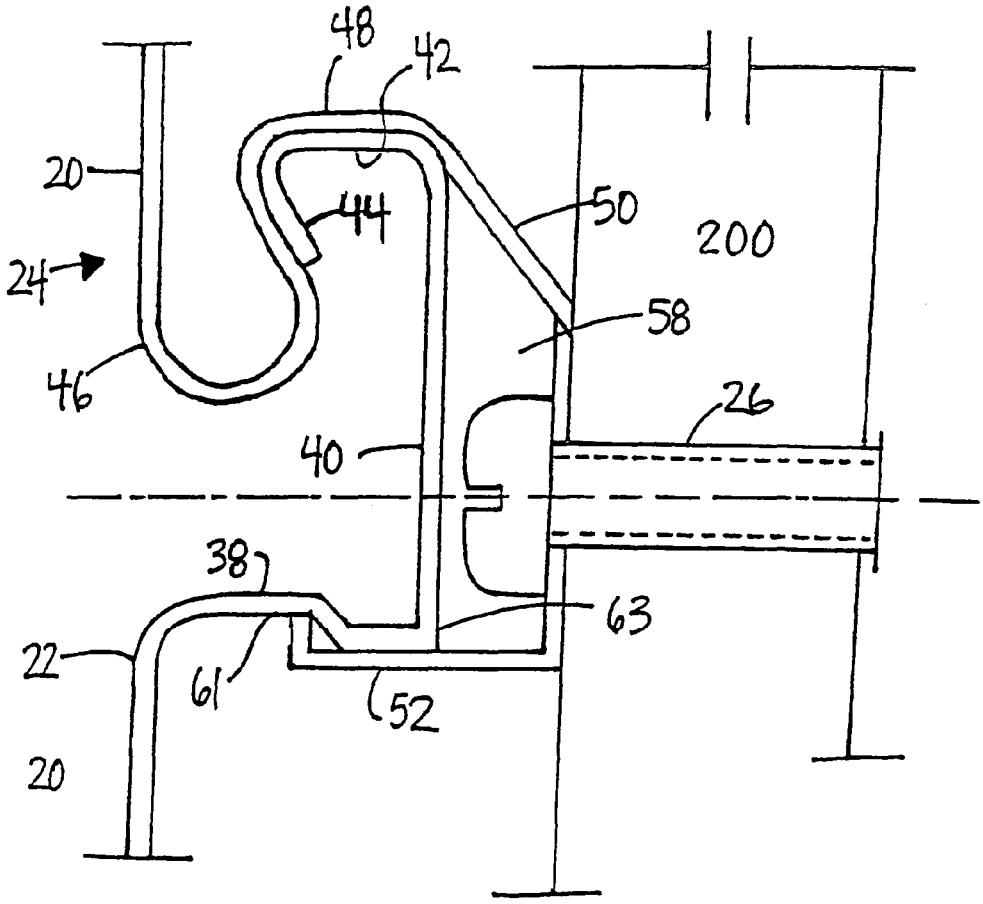
FIG. 6 of the drawings is a cross-sectional view of an embodiment of the present invention.

In another embodiment of the invention, as shown in FIG. 6, inward wall 38 of upper flange 22 may include notch 63 which corresponds to the concave region of outward wall 52 of the lower flange. To assemble such an embodiment, the user must force notch 63 beyond edge 61 of the concave surface which comprises outward wall 52 of the lower flange. To achieve same, the panels are capable of elastically deforming at least partially to facilitate the movement of the notch beyond the edge. Such a structure further precludes inadvertent rotation of the second slat relative to the first slat, and, in turn, inadvertent detachment of the two slats. This is especially useful in embodiments wherein certain of the second slats (or lower slats) are not attached to a wall or outside surface with attachment assemblies.

It will be understood that the first slat may include only a lower flange, and may omit an upper flange. Similarly, it will be understood that the last slat may include only an upper flange, and may omit a lower flange, while the intermediate slats positioned between the first and last slat include each of an upper flange and a lower flange. In addition, it is likewise contemplated that the body region of the varying slats within a slat wall assembly may be varied such that a variety of differently dimensioned slats can be incorporated into a single wall assembly.

Once the wall is fully assembled, various shelving units, hangars, attachments, and other devices can be attached to the slat wall assembly by way of the various assembled upper and lower flanges. In turn, the flanges retain the shelving units, hangars, and attachments in the desired orientation and provide the support for the items that are stored on the various storage containers.

Advantageously, the design facilitates the assembly by a relatively unskilled user. In particular, once the first slat is positioned in a leveled orientation and is attached to the underlying wall, subsequent slats can be attached quite easily in succession without further measurement and construction. Thus, in a relatively short time period, with relatively few calculations and engineering, a user can assemble a full slat wall assembly. In addition, the relative ease of installation coupled with the relatively low cost of manufacture renders the slat wall assembly well suited for renovation as well as new construction in both residential and commercial applications.

Figure 7A:
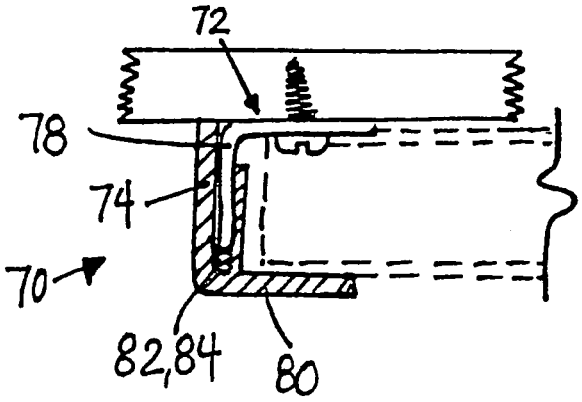
FIGS. 7*a*-7*e* of the drawings comprise cross-sectional views of various embodiments of the trim assembly.
Figure 7B:
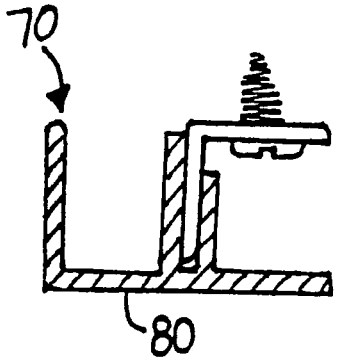
Figure 7C:
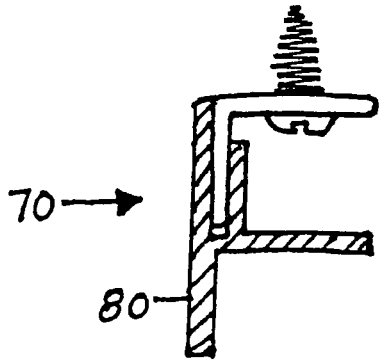
Figure 7D:
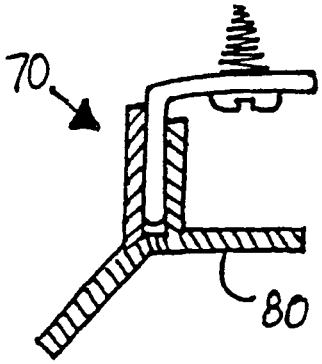
Figure 7E:
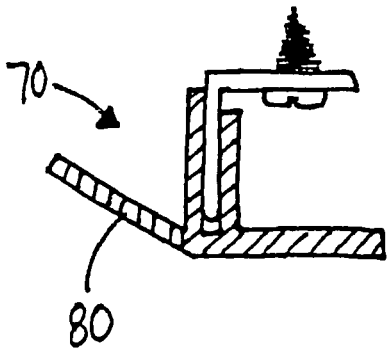

Referring to FIG. 7*a*, the invention further comprises trim assembly 70. Trim assembly 70 includes base bracket 72 and finish bracket 74. Base bracket 72 includes a first leg 76 and a second leg 78. The legs are joined, in the embodiment shown, into an "L" shape. In the embodiment shown, the base bracket comprises a single material which is formed into the desired orientation. Of course, various embodiments having different shapes are likewise contemplated, wherein the resulting function is similar to that of the base bracket.

Finish bracket 74 is shown in FIG. 7*a* as comprising exposed surface 80 and base bracket engaging region 82. Exposed surface 80 may comprise a variety of configurations which provide for a unique ornamental appearance. As is shown in FIGS. 7*a* through 7*e*, exposed surface 80 may comprise a variety of different configurations, so as to provide a decorative finish in a variety of installations. It will be understood that these are merely examples, and the invention is not limited to such configurations. Base bracket engaging region 82 is in FIG. 7*a* as comprising channel 84 sized so as to receive a portion of base bracket 72. In such an embodiment, the channel and the base bracket have an interference fit so that once positioned, the two are maintained in releasable engagement. It will be understood that in certain embodiments, the base bracket may include a receiving channel and the base bracket engaging region may comprise a structure capable of receipt in such a channel.

To assemble the trim assembly, the user first positions the base bracket so that the slats cooperate at the ends with the base bracket. The base bracket can extend along the entire length of the slat wall assembly, or, it can extend only along a portion of the slat wall assembly. Once positioned as desired, the base bracket is secured to the wall by way of screws, adhesive and/or other retaining means (including an interference fit and the like). Once positioned, and once the slats have been installed, finishing trim 74 is positioned such that channel 84 interfaces with base bracket 72. Advantageously, and as shown in FIG. 7*a*, a portion of exposed surface 80 covers the edge of the slat walls, to, in turn, provide a substantially uniform edge. Thus, the user is not required to carefully cut the individual slats to identical lengths, as the trim assembly is capable of accommodating slightly different lengths of slats.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A slat wall assembly for covering at least a portion of a wall of a structure, the assembly consisting of:

a plurality of identically constructed slat walls, wherein each of the slat walls consists of an upper flange and a lower flange spaced apart from one another by a body, the upper flange shaped as a channel extending inwardly and upwardly from the body, the lower flange shaped as a channel extending inwardly and downwardly from the body, wherein the channel of the lower flange is sized to matingly receive the channel of the upper flange of another slat wall, and wherein at least a portion of the lower flange includes a support wall which contacts the wall; and wherein when the upper flange of a first slat wall is matingly received within the lower flange of a second slat wall, the upper flange of the first slat wall and the lower flange of the second slat wall cooperate to define a retaining recess for enclosing one or more fasteners which can be inserted through the lower flange to secure the slat wall to the wall.

* * * * *